US008671635B2

(12) United States Patent
Jones

(10) Patent No.: US 8,671,635 B2
(45) Date of Patent: Mar. 18, 2014

(54) PERIMETER PEDESTALS

(76) Inventor: Nigel Jones, Seattle, WA (US)

( * ) Notice: Subject to any disclaimer, the term of this patent is extended or adjusted under 35 U.S.C. 154(b) by 369 days.

(21) Appl. No.: 12/983,886

(22) Filed: Jan. 4, 2011

(65) Prior Publication Data

US 2012/0168592 A1 Jul. 5, 2012

(51) Int. Cl.
*E04B 5/00* (2006.01)
*E04F 15/02* (2006.01)

(52) U.S. Cl.
CPC ..... *E04F 15/02005* (2013.01)
USPC ..... 52/263; 52/396.1; 52/126.6; 211/85.19; 211/85.18; 248/346.01; 248/310; 248/311.2; 108/150

(58) Field of Classification Search
CPC ..... E01C 5/223; E04F 15/02005; E04F 15/02464
USPC ..... 52/263, 396.1, 677, 126.6; 248/346.01, 248/346.03, 346.05, 346.07, 346.3, 346.5, 248/150, 188.8, 158, 310, 311.2, 677, 678; 211/71.01, 74, 85.19, 85.18; 108/150; 403/289, 390, 391; 402/37, 43
See application file for complete search history.

(56) References Cited

U.S. PATENT DOCUMENTS 288,617 A * 11/1883 Bradley ..... 211/74
289,027 A * 11/1883 Ripley ..... 211/74
543,938 A * 8/1895 Larrabee ..... 211/74
1,084,243 A * 1/1914 Young ..... 211/74
1,168,535 A * 1/1916 Moltrum ..... 232/41 E
2,210,102 A * 8/1940 Steudel ..... 248/346.01
2,280,220 A * 4/1942 Crosby ..... 52/126.6
2,313,944 A * 3/1943 Keener et al. ..... 224/201
2,510,591 A * 6/1950 Listman ..... 206/199
2,546,492 A * 3/1951 Booth ..... 248/188.8
2,985,310 A * 5/1961 Norris ..... 211/74
3,065,857 A * 11/1962 Sanders ..... 211/85.19
3,318,057 A * 5/1967 Norsworthy ..... 52/126.6
3,399,553 A * 9/1968 Lehto ..... 70/158
3,425,179 A * 2/1969 Haroldson ..... 52/283
3,470,663 A * 10/1969 Tate ..... 52/126.6
3,482,756 A * 12/1969 Collie ..... 229/406
3,494,308 A * 2/1970 Perrin ..... 108/150
3,540,175 A * 11/1970 Hawn ..... 52/126.6
3,616,584 A * 11/1971 Sartori et al. ..... 52/126.6
3,746,178 A * 7/1973 Wagschal ..... 211/74
3,861,098 A * 1/1975 Schaub ..... 52/98
3,949,876 A * 4/1976 Bridges et al. ..... 206/427
4,011,951 A * 3/1977 Boyer ..... 211/85.21
4,060,954 A * 12/1977 Liuzza ..... 52/677
4,130,200 A * 12/1978 Iepson et al. ..... 206/705
4,277,923 A * 7/1981 Rebentisch et al. ..... 52/126.6
4,319,520 A * 3/1982 Lanting et al. ..... 454/290

(Continued)

*Primary Examiner* — Kimberly Wood
(74) *Attorney, Agent, or Firm* — Baumgartner Patent Law; Marc Baumgartner

(57) ABSTRACT

Pedestal assemblies configured to support first and second pavers positioned adjacently against an elevated periphery and methods of making the same are provided herein. Preferred assemblies include a cap, base, and at least two towers configured to be sandwiched between the cap and base. Kits can be sold with just cap and base alone. Preferred caps and bases can be formed in the same shape or substantially so, and are racetrack-shaped. Preferred towers include polyvinyl chloride (PVC) cylindrical tubing. The cap can advantageously include an upwardly-projecting fin used to align and separate two pavers positioned alongside an elevated periphery. A pedestal support system can include both periphery pedestals in addition to conventional pedestals positioned away from the elevated periphery.

17 Claims, 7 Drawing Sheets

(56) References Cited

U.S. PATENT DOCUMENTS

| | | | | | |
|---|---|---|---|---|---|
| 4,546,580 | A * | 10/1985 | Ueno et al. | 52/126.1 |
| 4,613,048 | A * | 9/1986 | McGill | 224/400 |
| 4,736,555 | A * | 4/1988 | Nagare et al. | 52/126.6 |
| 4,883,503 | A * | 11/1989 | Fish | 52/263 |
| 4,899,497 | A * | 2/1990 | Madl, Jr. | 52/126.6 |
| 4,901,490 | A * | 2/1990 | Zinniel et al. | 52/263 |
| 4,905,437 | A * | 3/1990 | Heather | 52/263 |
| 5,170,980 | A * | 12/1992 | Burrows et al. | 248/311.2 |
| 5,283,996 | A * | 2/1994 | Myers | 52/223.6 |
| 5,288,534 | A * | 2/1994 | Tavshanjian | 428/64.1 |
| 5,363,614 | A * | 11/1994 | Faulkner | 52/263 |
| 5,383,635 | A * | 1/1995 | Barone | 248/188.1 |
| 5,400,554 | A * | 3/1995 | Lo | 52/126.5 |
| 5,412,914 | A * | 5/1995 | Daw et al. | 52/126.6 |
| 5,479,745 | A * | 1/1996 | Kawai et al. | 52/126.6 |
| RE35,369 | E * | 11/1996 | Ducroux et al. | 52/126.6 |
| 5,588,264 | A * | 12/1996 | Buzon | 52/126.6 |
| 5,628,157 | A * | 5/1997 | Chen | 52/263 |
| 5,791,096 | A * | 8/1998 | Chen | 52/126.6 |
| 5,862,643 | A * | 1/1999 | Schilham | 52/745.19 |
| 6,282,860 | B1 * | 9/2001 | Ramirez | 52/677 |
| 6,332,292 | B1 * | 12/2001 | Buzon | 52/126.6 |
| 6,363,685 | B1 * | 4/2002 | Kugler | 52/745.05 |
| 6,370,831 | B1 * | 4/2002 | Marshall et al. | 52/263 |
| 6,463,704 | B1 * | 10/2002 | Jette | 52/125.2 |
| 6,519,902 | B1 * | 2/2003 | Scissom | 52/126.4 |
| 6,520,471 | B2 * | 2/2003 | Jones et al. | 248/346.5 |
| 6,625,951 | B1 * | 9/2003 | McCarthy | 52/747.1 |
| 6,983,570 | B2 * | 1/2006 | Mead | 52/263 |
| 7,232,444 | B2 * | 6/2007 | Chang | 606/131 |
| 7,249,741 | B1 * | 7/2007 | Larson | 248/188.1 |
| 7,360,343 | B1 * | 4/2008 | Spransy et al. | 52/263 |
| 7,509,782 | B2 * | 3/2009 | Colosimo et al. | 52/792.1 |
| D592,911 | S * | 5/2009 | Buchanan | D7/605 |
| 7,650,726 | B2 * | 1/2010 | Jakob-Bamberg et al. | 52/263 |
| 7,866,096 | B2 * | 1/2011 | Lee et al. | 52/126.6 |
| 8,256,175 | B2 * | 9/2012 | Buzon | 52/263 |
| 8,302,356 | B2 * | 11/2012 | Knight et al. | 52/263 |
| 8,381,461 | B2 * | 2/2013 | Repasky | 52/126.6 |
| 2002/0078638 | A1 * | 6/2002 | Huang | 52/126.6 |
| 2002/0148173 | A1 * | 10/2002 | Kugler | 52/126.6 |
| 2004/0035064 | A1 * | 2/2004 | Kugler et al. | 52/126.6 |
| 2007/0186498 | A1 * | 8/2007 | Buzon | 52/263 |
| 2008/0105172 | A1 * | 5/2008 | Repasky | 108/144.11 |
| 2010/0300015 | A1 * | 12/2010 | Wang et al. | 52/126.6 |
| 2011/0138703 | A1 * | 6/2011 | Repasky | 52/126.6 |
| 2011/0232208 | A1 * | 9/2011 | Tabibnia | 52/126.6 |
| 2011/0239550 | A1 * | 10/2011 | Kugler et al. | 52/126.6 |
| 2012/0036796 | A1 * | 2/2012 | Camilli | 52/126.6 |
| 2012/0272588 | A1 * | 11/2012 | Kugler et al. | 52/126.6 |
| 2012/0272589 | A1 * | 11/2012 | Kugler et al. | 52/126.6 |
| 2012/0291369 | A1 * | 11/2012 | Knight et al. | 52/126.6 |

* cited by examiner

PERIMETER PEDESTALS

FIELD OF THE INVENTION

The teachings herein are directed to pedestal systems for supporting and elevating a paver deck assembly, and in particular pedestal assemblies configured to support pavers alongside an elevated perimeter, such as a wall or curb.

BACKGROUND

A paver assembly, typically composed of stone, ceramic, or concrete pavers, is commonly used for exterior hardscaping applications. Paver assemblies can be used for a variety of purposes, such as walkways, patios, pool decks and driveways. Paver assemblies offer an alternative to plain concrete or asphalt, and offer numerous functional and aesthetic advantages. The high compressive strength of concrete paving stones offers a more durable choice compared to clay bricks or poured-in-place concrete. Clay pavers have the advantage of greater resistance to fading from the sun and deterioration from long term exposure to the elements. The wide variety of shapes, colors, and designs available for pavers can produce a very appealing surface.

Pedestal systems used to elevate, level, and uniformly space paver stones and other natural products are known in the art. For example, U.S. Pat. No. 6,520,471 to Jones et al. describes a pedestal support system for an elevated paver deck assembly. The assembly of pavers is supported by an array of pedestal assemblies that can be set by the user to a desired height. Such a system is appropriate for elevated foot traffic or the creation of usable space on roof deck and patios, and other areas. Systems can turn difficult slopes into level surfaces and allow utilities and drains to be run under the pavers, natural stone, or other manufactured products, thus creating usable space from otherwise unusable areas. Water can move freely to allow for the health and long life of a roofing membrane, as substrate surfaces are waterproofed and protected from the elements. Pedestal systems are especially useful with patio pavers, a generic term given to describe any regular type of paver that is specifically used for the construction of an outdoor patio deck.

Current systems such as those disclosed in Jones, often use cylindrical pedestals that are placed between the paver squares, such that each pedestal is placed at the intersection of four paver squares. This placement of pedestals provides the strongest system, thereby enabling the surface to withstand the maximum weight load. While this method is ideal for supporting pavers in the middle of the patio, problems often arise with setting pavers near an elevated perimeter such as a wall or curb, for example. The cylindrical shape often makes it difficult to position a pedestal close enough to the elevated perimeter to have a significant upper surface area that supports the pavers as it cannot be positioned flush against the elevated perimeter. Additionally, when cylindrical pedestals are positioned against a wall, often the top obstructing fins of the pedestal are cut off to enable the installation. Removing the top fins of the pedestal is not ideal or generally will not work when the paver is less than 7 inches wide. When installing a narrow cut paver, install crews often substitute materials or combine various components of existing materials such as bricks to provide support for the narrow cut paver. Additionally, a traditional pedestal often cannot be placed close enough to the perimeter of the wall due to cants at the wall base and/or the cylindrical nature of the pedestal. Accordingly there is a need to provide an improved perimeter pedestal assembly and system for supporting pavers and that can be positioned closely alongside the edges of an elevated periphery, such as a wall, barrier, or curb.

Accordingly, it is the object of the teachings herein to provide a pedestal support system made up of pedestal assemblies that can be easily placed closely alongside the perimeter of a wall, curb, or barrier, and also elevate and support a plurality of pavers.

SUMMARY OF THE INVENTION

Embodiments herein are directed to pedestal assemblies configured to utilize first and second towers to support first and second adjacent pavers, and comprising a base having an upper surface with first and second means for respectively coupling to and supporting bottom ends of first and second towers; and a cap having an upper surface configured to support the undersides of said first and second adjacent pavers and an underside having first and second means for respectively coupling to top ends of said first and second towers.

Further embodiments are directed to pedestal systems comprising (a) a peripheral pedestal assembly configured to utilize first and second towers to support first and second adjacent pavers, and comprising a base having an upper surface having first and second means for respectively coupling to and supporting bottom ends of first and second towers; and a cap having an upper surface configured to support the undersides of said first and second adjacent pavers and an underside having first and second means for respectively coupling to top ends of said first and second towers; and (b) a second pedestal assembly configured to utilize no more than a single tower to support corners of four adjacent pavers, and comprising a base having an upper surface having means for respectively coupling to and supporting the bottom end of the single tower; and a cap having an upper surface having a upwardly projecting spacer configured to separate the underside corners of four pavers and an underside having means for coupling to the top end of the single tower.

Additional embodiments are directed to methods of making a pedestal assembly configured to utilize first and second towers to support first and second adjacent pavers, and comprising providing a thermoplastic injection mold configured to set a base having an upper surface with first and second means for respectively coupling to and supporting bottom ends of first and second towers; providing a thermoplastic injection mold configured to set a cap having an upper surface configured to support the undersides of said first and second adjacent pavers and an underside having first and second means for respectively coupling to top ends of said first and second towers; injecting liquid thermoplastic material into said base and cap molds such that thermoplastic material sets within the molds; and removing set thermoplastic material from said molds.

DETAILED DESCRIPTION OF THE ILLUSTRATED EMBODIMENTS

Embodiments of the present invention are described below. It is, however, expressly noted that the present invention is not limited to these embodiments, but rather the intention is that modifications that are apparent to the person skilled in the art and equivalents thereof are also included.

Preferred teachings herein are directed to pedestal assemblies that utilize towers positioned between a racetrack-shaped cap and a racetrack-shaped base and that can be readily placed alongside a raised perimeter, such as a wall, curb, or barrier to support a plurality of pavers.

Figure 1:
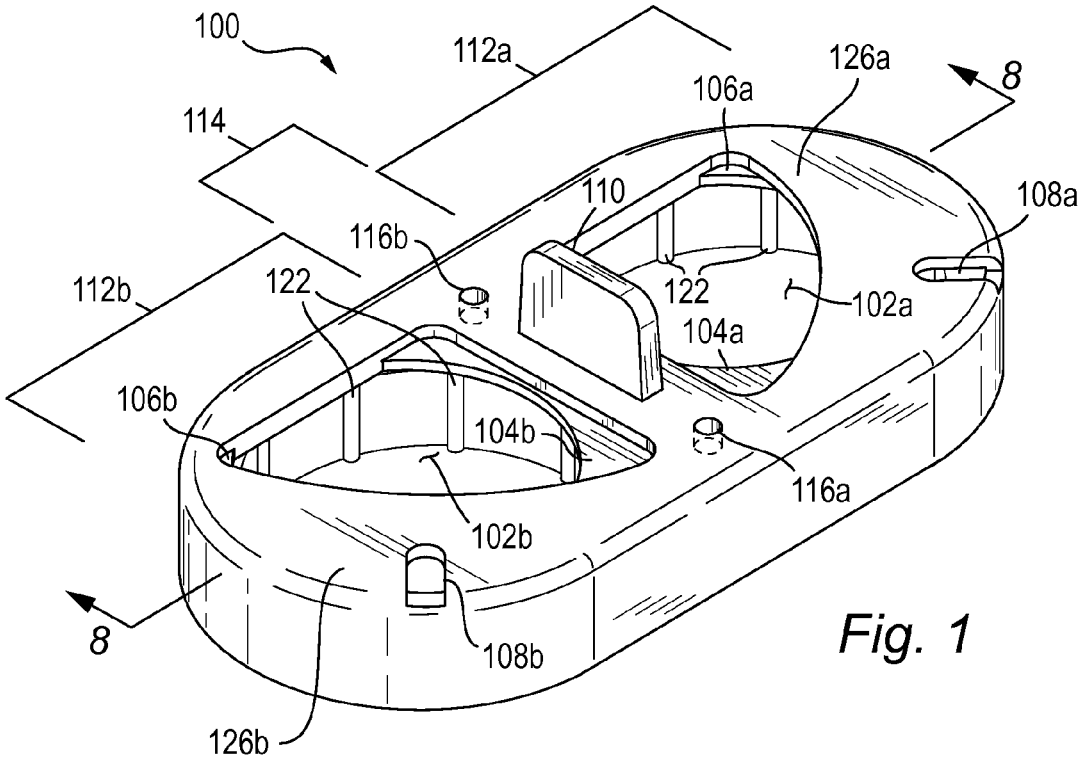
FIG. 1 is a topside view of a pedestal cap.

In general a cap 100 is preferably configured to support the underside corner areas of two adjacent pavers aligned against an elevated periphery and also to couple to the top areas of two support towers. FIG. 1 illustrates a top view of a preferred racetrack-shaped pedestal cap 100 having its longest sides, (the front and back sides) parallel with each other and coupled together by left and right curved sides. Preferably the cap 100 includes a central section 114 dividing the cap 100 into a left side 112*a* and a right side 112*b*. The cap 100 includes upper surface areas 126*a* and 126*b* on its left and right side that are configured to support the underside corner areas of first and second pavers. Advantageously, the upper surface areas 126*a* and 126*b* can be planar or substantially so to allow for level support of pavers.

Figure 5:
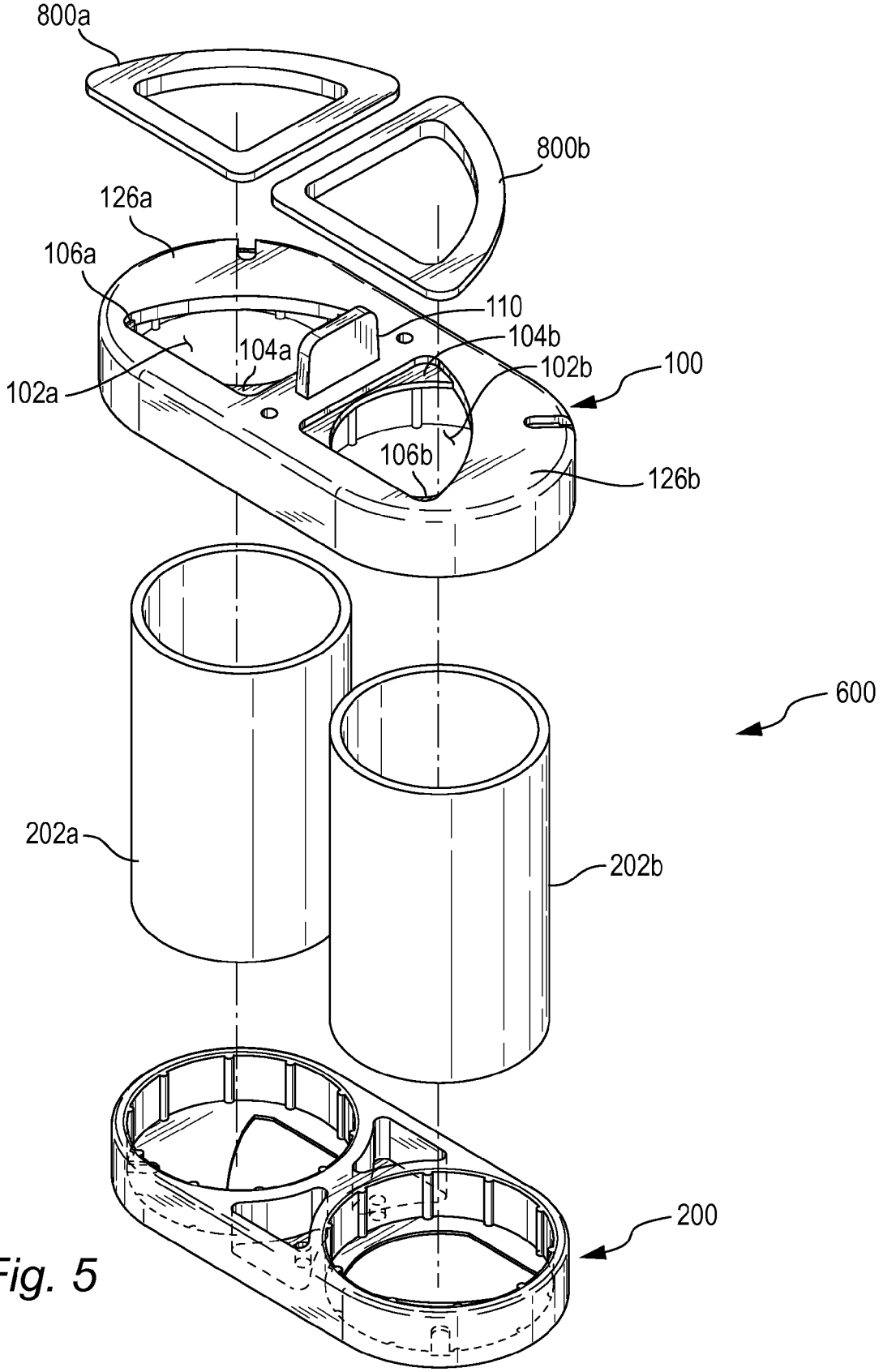
FIG. 5 is an exploded view of a cap and base, left and right towers, and left and right shims.

Optionally the cap 100 can include left and right cutouts 102*a* and 102*b* that open into recesses 124*a* and 124*b* below and can be used for inserting shims 800*a* and 800*b*. The cap cutouts can be in any suitable shape such that they can support a complementary shaped shim, but in preferred embodiments, and as shown in FIG. 5, the cutouts 102*a* and 102*b* are quadrant-shaped, or in other words, in the shape of a quarter of a circle. Flanges 104*a* and 106*a* within the left cutout 102*a* are configured to hold a first shim 800*a* on the left side 112*a* of the cap 100 while flanges 104*b* and 106*b* within the right cutout 102*b* are configured to hold a second shim 800*b* on the right side 112*b* of the cap 100. Alternatively, the cap does not include cutouts, and just includes means for coupling to the top of the towers on its underside. Outer drainage holes 108*a* and 108*b*, as well as centrally located drainage holes 116*a* and 116*b*, can be utilized in the cap 100 to prevent water from building up underneath and around the pavers.

A fin 110 is preferably coupled to the topside of the cap 100 running perpendicular to the long front and back sides, and configured to align and space two adjacent pavers positioned against an elevated periphery. Having a single straight fin 110 is advantageous, as a cross shaped fin 904 would not allow a paver 900 to be flush against an elevated periphery 904 (See FIG. 7).

Figure 2:
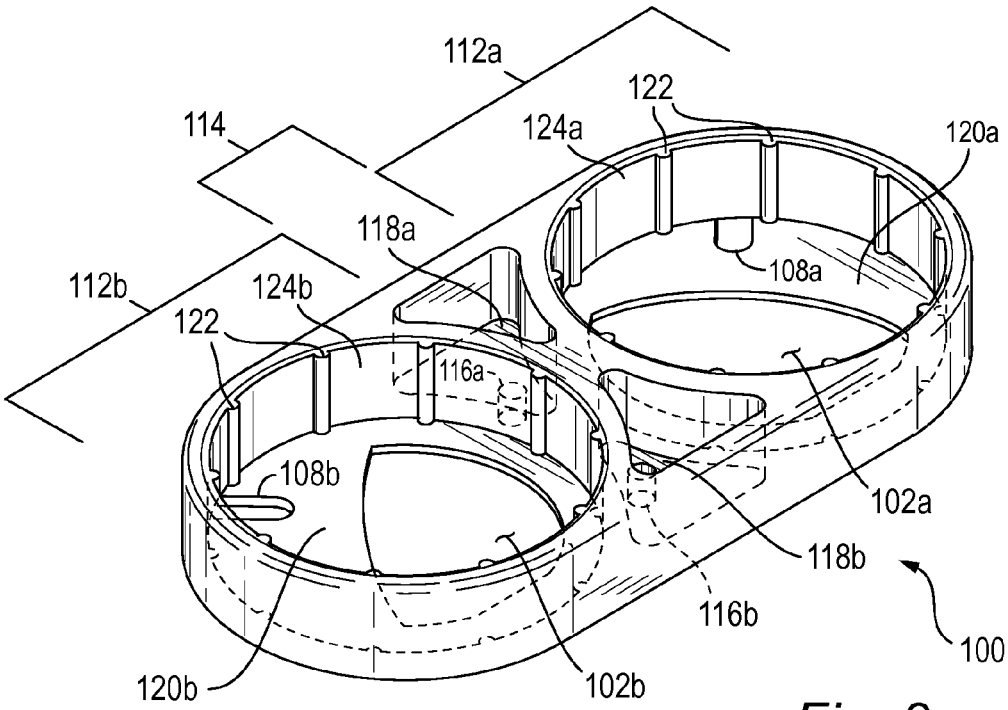
FIG. 2 is an underside view of a pedestal cap.

While shown as a race-track shape in FIGS. 1 and 2, the cap can be shaped in other alternative forms according to non-preferred embodiments. More specifically the cap could be molded into the shape of a rectangle or square, for example. It is preferred that the cap includes a back side configured to abut against and be substantially parallel to an elevated periphery while the front side is designed to face away from the elevated periphery. The front side is preferably parallel to the back side but can be in any suitable configuration, such as curved for example. It is also preferred that the front and back sides comprise the longest two sides of the cap. Additional non-preferred embodiments would allow for more than two towers to be coupled to the cap, such as 3, 4, or 5, for example. According to this embodiment the cap would have the complementary number of coupling means as there are towers. For example, if the assembly was designed to utilized three towers, the cap could include three recesses configured to couple to the top of the towers. Regardless of the number of towers utilized, it is preferred that the means for coupling the towers in the cap are aligned in a straight row, such that the towers are aligned parallel to the elevated periphery.

FIG. 2 shows the underside of a preferred cap 100. Cavities 118*a* and 118*b* are configured to allow water to drain from the drainage holes 116*a* and 116*b*. The underside of the cap 100 is further comprised of a left cylindrical recess 124*a* and right cylindrical recess 124*b* configured to receive the upper ends of left and right cylindrical towers 202*a* and 202*b*. Accordingly, the diameter of the cylindrical recesses 124*a* and 124*b* is slightly greater than the diameters of the left and right cylindrical towers 202*a* and 202*b*. Advantageously, the perimeters of the cylindrical recesses 124*a* and 124*b* are lined with a plurality of vertically traversing ribs 122 to help ensure a snug fit between the top ends of the cylindrical towers 202*a* and 202*b* and the cap 100. This configuration is advantageous in preventing slippage and rotation of the towers 202*a* and 202*b* when in use. When installed, the tops of the towers preferably abut against the upper surfaces 120*a* and 120*b* of the cylindrical recesses 124*a* and 124*b*. While cylindrical recesses are shown in FIG. 2, any suitable coupling means can be used by the cap to couple to the tops of the towers 202*a* and 202*b*, depending on the shape and material of the towers. Examples of coupling means non-exclusively include clamps, snaps, and the like, for example.

Figure 3:
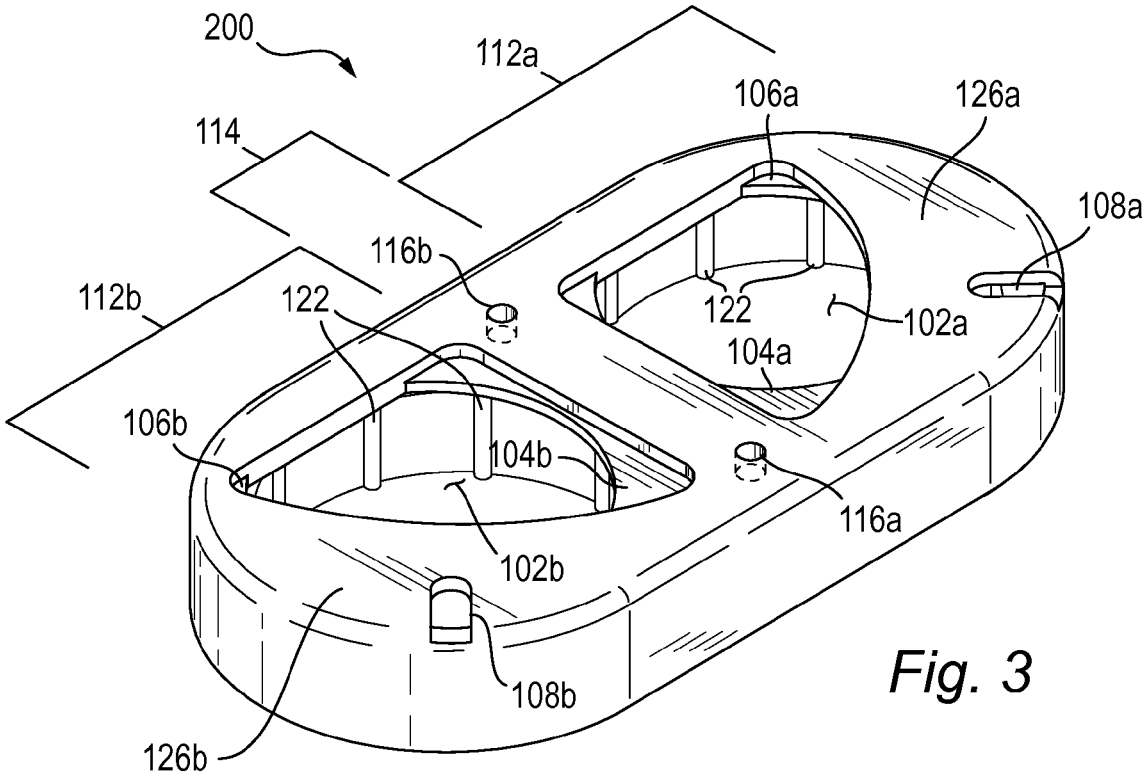
FIG. 3 is an underside view of a pedestal base.
Figure 4:
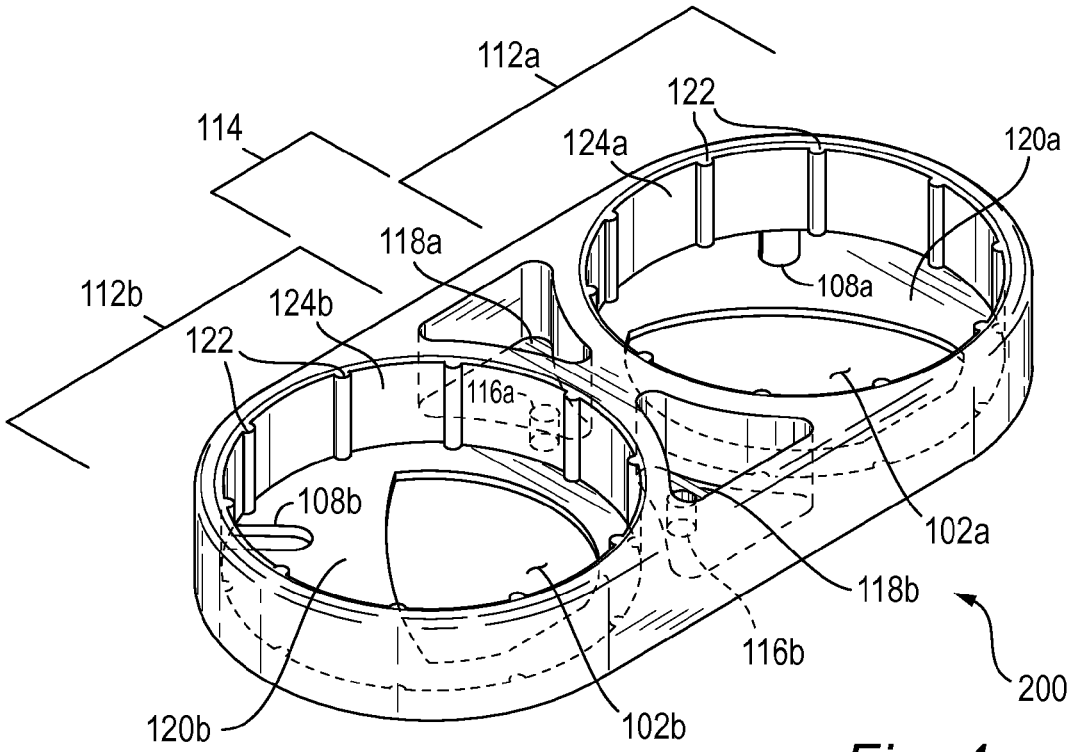
FIG. 4 is a topside view of a pedestal base.

FIGS. 3 and 4 illustrate the underside view and topside view of the base 200, respectively. According to preferred embodiments, the cap 100 and the base 200 are essentially the same piece except for the presence of the fin 110 on top of the cap. Accordingly, the dimensions and features of the base 200 can be nearly identical to those of the cap 100. Thus the structural disclosure related to the cap 100 provided above can be applied to the base 200 with the exception of the fin 110*b*. The cylindrical recesses 124*a* and 124*b* in the base 200 are configured to secure the bottom areas of the towers 202*a* and 202*b* just as the cylindrical recesses in the cap are configured to receive the tops of the towers. The bottom ends of the towers 202*a* and 202*b* preferably abut against the bottom sides 120*a* and 120*b* of the cylindrical recesses 124*a* and 124*b*. While cylindrical recesses are shown in FIG. 4, any suitable coupling means can be used by the base to couple to the bottoms of the towers, depending on the shape and material of the towers. Examples of coupling means non-exclusively include clamps, snaps, and the like, for example. Drainage holes 116*a*, 116*b*, 108*a*, and 108*b* can also be incorporated to prevent water buildup within the pedestal assembly 600 and around the base 200. Alternative embodiments can include the use of a base shim underneath the base to allow for height variations.

While shown as a race-track shape in FIGS. 3 and 4, the base can be shaped in other alternative forms according to non-preferred embodiments. More specifically, the base could be molded into the shape of a rectangle or square for example. It is preferred that the base includes a back side configured to abut against and be substantially parallel to an elevated periphery while the front side is designed to face away from the elevated periphery. The front side is preferably parallel to the back side but can be in any suitable configuration, such as curved for example. It is also preferred that the front and back sides comprise the longest two sides of the base. Additional non-preferred embodiments would allow for more than two towers to be coupled to the base, such as 3, 4, or 5, for example. According to this embodiment the base would have the complementary number of coupling means as there are towers. For example, if the assembly was designed to utilized three towers, the base could include three recesses configured to couple to the bottom of the towers. Regardless of the number of towers utilized, it is preferred that the means for coupling the towers in the base are aligned in a straight row, such that the towers are aligned parallel to the elevated periphery.

In alternative embodiments, the base and cap can actually be identical pieces. For example, the top of the cap (underside of the base) could include means for releasable attachment to a fin, such as a slot that the fin snaps into. As the slot on the underside of the base would not interfere with the stability of the pedestal assembly, the base and cap can be identical pieces according to this embodiment. Additionally, when the installation area includes a corner defined by two elevated peripheries support for a paver in said corner can be achieved by utilizing two bases as a cap and base, thereby forgoing the fin which would interfere with the support of a single corner paver in this position. Accordingly, the base and cap can be identical in certain embodiments of the teachings herein.

While the cap 100 and base 200 can be made of any suitable material it is preferred the material be weather resistant and strong. According to preferred embodiments, the cap 100 and base 200 utilize acrylonitrile butadiene styrene (ABS), a material known for its strength, resilience, and good chemical resistance. Additional material such as other thermoplastics can also be used with injection molding to form the base 200 and cap 100. Regardless of whether the base and cap are the same or substantially the same, either embodiment allows for simplified manufacturing as the two pieces can be manufactured from the same mold. For embodiments where the cap 100 includes a fin 110, the fin cavity in the mold can be filled with a removable blocking insert to create a finless base 200. Conversely, the blocking insert in the mold can be removed to create a cap 100 with a fin 110. Creating variation on a part from a single mold is well known in the manufacturing field, such as the injection molding industry. Such techniques are expressly contemplated by the teachings herein.

Figure 6:
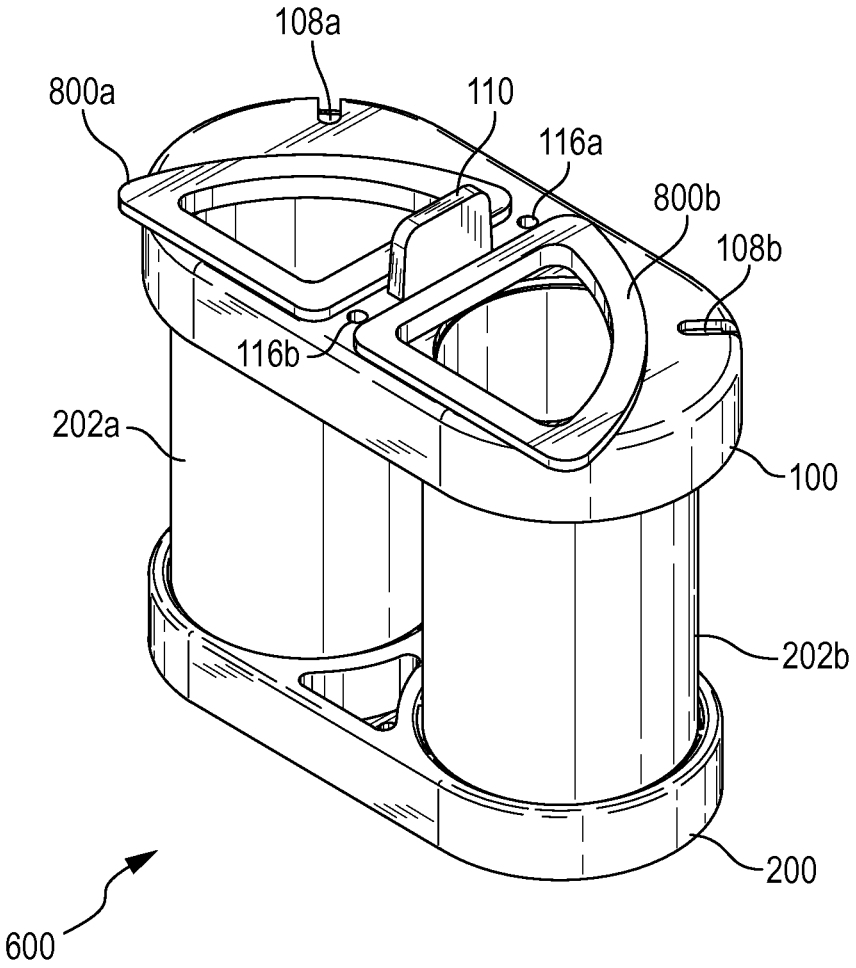
FIG. 6 is a perspective view of an assembled pedestal with shims positioned on the cap.

FIG. 5 shows an exploded view of the individual components of a preferred pedestal assembly 600, while FIG. 6 shows a preferred pedestal assembled 600. The preferred pedestal assembly 600 includes a base 200, a left tower 202*a* and a right tower 202*b*, and a cap 100. In this embodiment, the two towers 202*a* and 202*b* are configured to fit in the cylindrical recesses 124*a* and 124*b* of the base 200 and the underside of cap 100, such that the base 200 and cap 100 sandwich the towers 202*a* and 202*b*. The height of the pedestal assembly 600 can be set by the user selecting and/or cutting the length of the first and second towers 202*a* and 202*b*. The towers can be made in any suitable shape such as a rectangular prism and made of any suitable material including thermoplastics and metal. However, in preferred embodiments, cylindrical tubing, such as conventional polyvinyl chloride (PVC) tubing is used as the towers 202*a* and 202*b*. PVC tubing is commonly available and in the construction industry and is affordable. Additionally PVC tubing can be easily cut to adjust the height of the pedestal assemblies 600 herein. Thus an installer can easily accommodate projects that involve pavers that need to be installed at different heights such as stairs and platforms, for example. The use of PVC tubing relieves the manufacture of the burden of producing multiple towers of different sizes and allow for more uniformity in product. Preferred embodiments of the invention use 1½" Schedule 40 PVC, also known as ASTM #D2665. Such PVC is generally available in two different wall thicknesses, each having the same outside diameter and either type may be used to form the towers 202*a* and 202*b*. According to alternative non-preferred embodiments, the towers can be sold as vertically telescoping towers to allow for height adjustment or with predetermined heights. Other height adjustment means including an adjustable rotating base are also contemplated herein. As discussed in more detail below, two shims 800*a* and 800*b* can be added to the top of the cap 100 to make the pavers level.

Figure 7:
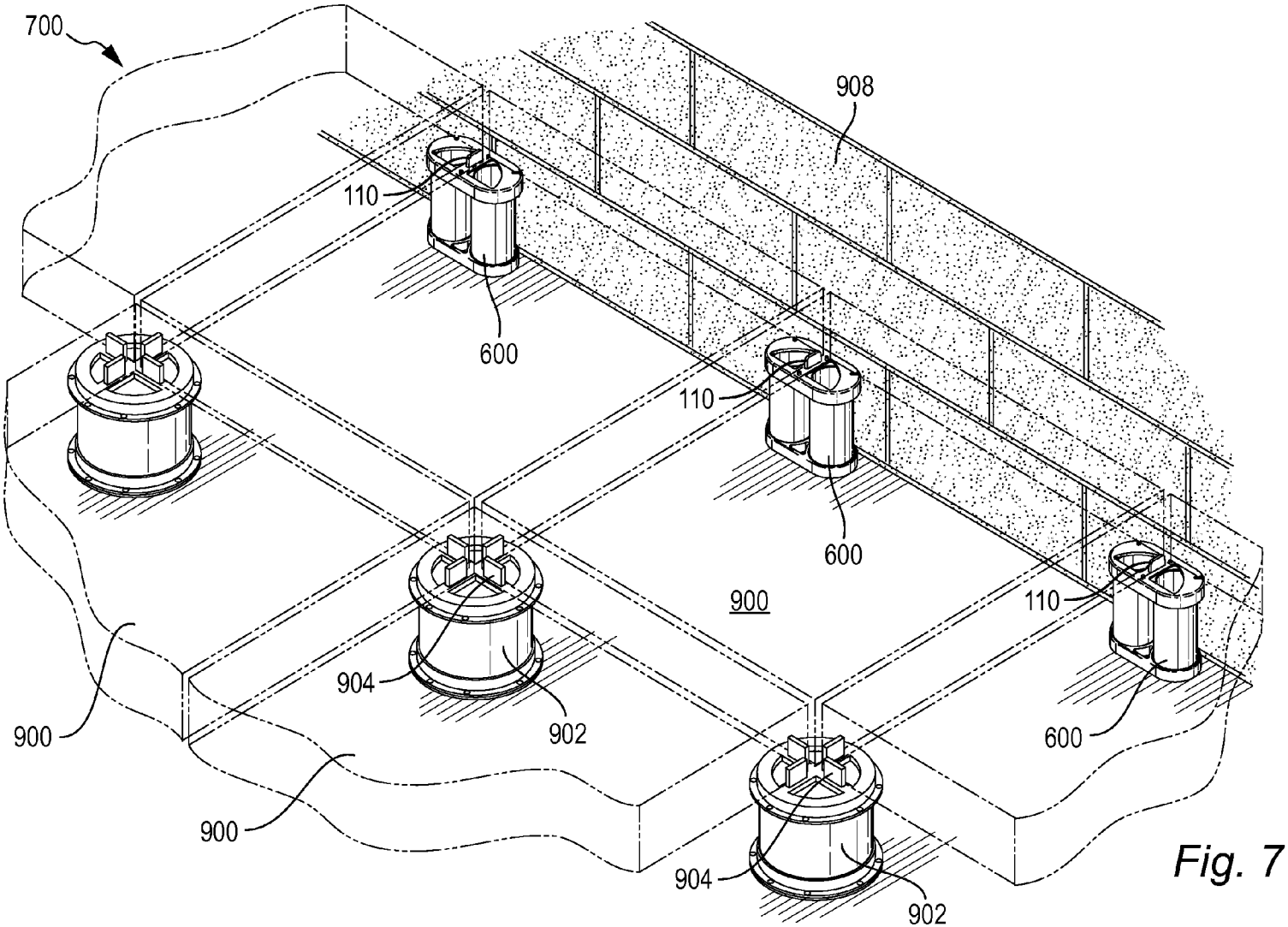
FIG. 7 is a pedestal system utilizing racetrack-shaped and cylindrical pedestals.

FIG. 7 illustrates a pedestal system 700 used to elevate a plurality of pavers 900. Said pedestal system 700 comprises a plurality of perimeter pedestal assemblies 600 abutting against a wall 908 or coming substantially close to doing so, and supporting the corner areas of two adjacent pavers 900. In contrast, paver corners that are not installed against the elevated periphery 908 can be supported by traditional pedestals, such as the primarily cylindrical pedestals 902 or pedestals otherwise having cross-shape fins or spacers 904. Preferred conventional pedestals 902 are disclosed in U.S. Pat. No. 6,520,471 to Jones and are readily available from AWS® PEDESTAL SYSTEMS™ (Seattle, Wash.). Such cylindrical pedestals are ideal for supporting pavers 900 away from the wall 908, as the four upwardly-projecting fins 904 align four pavers, but result in problems when attempting to support two pavers 900 alongside a wall 908. Thus, according to preferred embodiments the pedestal system 700 can utilize both periphery pedestals 600 along the wall 908 and cylindrical pedestals 902 away from the wall 908. Such a design preferably achieves the maximum load bearing ability for the patio deck, as the pedestal system 700 is able to support the weight of the pavers, people standing on the pavers, and other objects positioned on the pavers, such as furniture.

Figure 12:
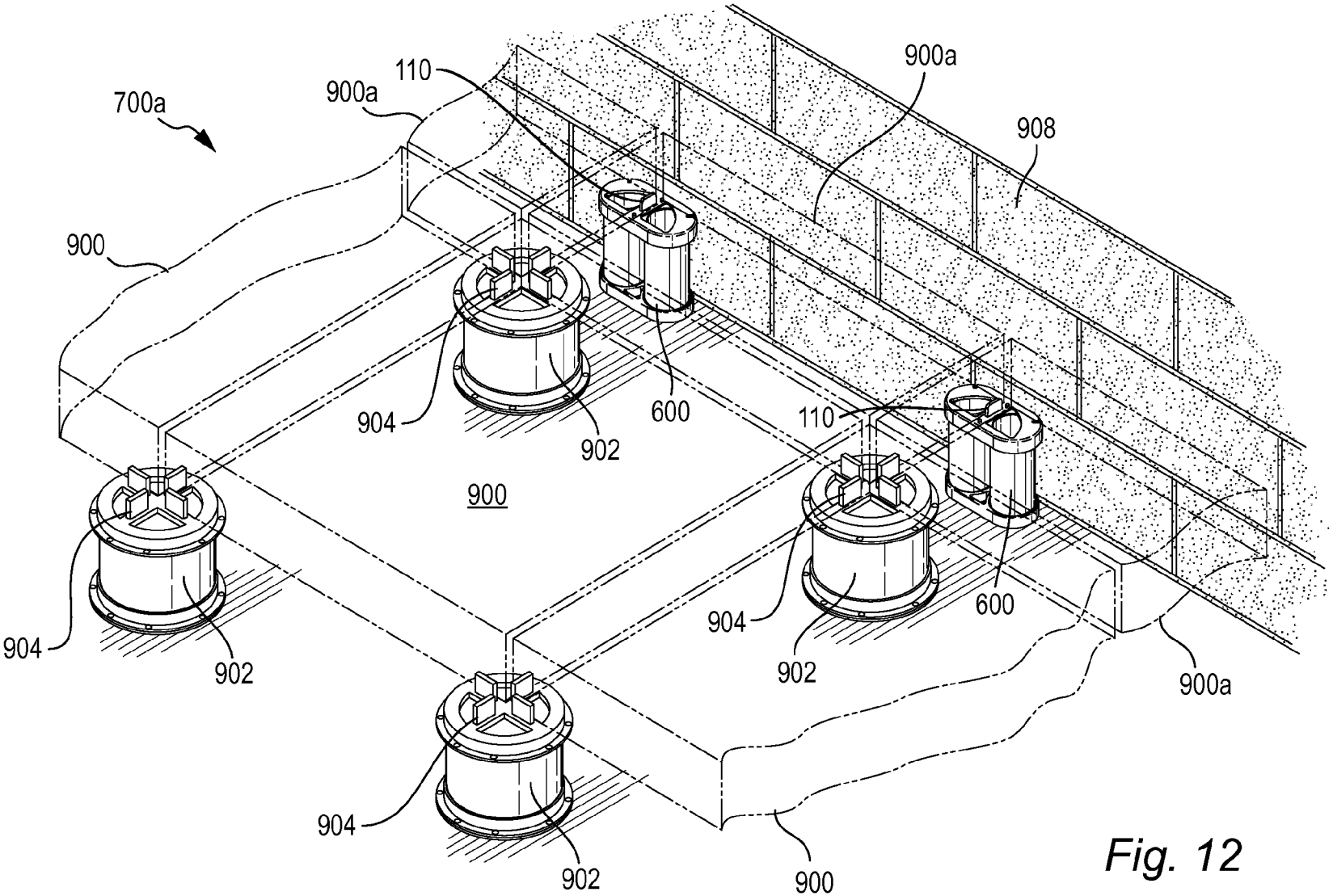
FIG. 12 is a perspective view a pedestal system utilizing racetrack-shaped and cylindrical pedestals.

FIG. 12 shows a preferred system 700*a* of perimeter pedestals 600 and cylindrical pedestals 902. According to this system the perimeter pedestal 600 is used to support two adjacent thin cut pavers 900*a* positioned against a wall 908. As shown in FIG. 12, if the perimeter pedestal assemblies 600 were not used, such that only the cylindrical pedestals 902 were present, the thin cut pavers 900*a* would have an unsupported end positioned against the wall 908. The perimeter pedestals 600 provided herein are a much easier solution than having an installer using scrap parts such as bricks to try and support and level the thin cut pavers 900*a* positioned against a wall 908. Thin cut pavers 900*a* are often needed because the size of the surface area of an installation area is rarely wholly divisible by the surface area of a commercially available or standard sized paver 900. As such the standard paver 900 is often cut to form a thin cut paver 900*a* in order cover the entire surface area of the installation area. Thin cut pavers 900*a* can be any paver that has a width less than the width of the standard, or predominantly used paver 900 in the paver assembly. In general the pavers 900 that are positioned away from the elevated perimeter(s) 908 are the standard sized or predominant pavers 900, although the predominant pavers can also be positioned against an elevated perimeter 908 as well (see FIG. 7). In general thin cut pavers 900*a* are usually less than ¾, ½, or ¼ the width of the standard or predominant paver 900 and are preferably less than 7 inches wide when used with the perimeter pedestals 600 provided herein. The perimeter pedestals 600 described herein can be used to support thin cut pavers of any suitable shape, non-exclusively including squares, curves, irregular shapes, and triangles, such as when the elevated perimeter is angled, for example.

Figure 8:
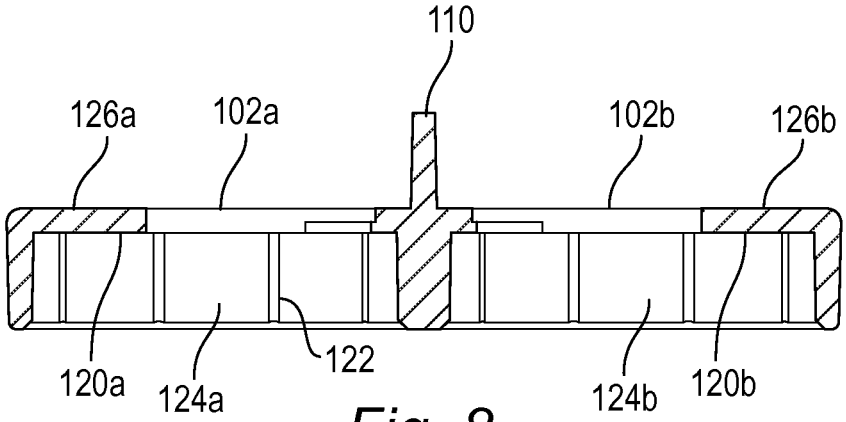
FIG. 8 is a cross sectional view of a pedestal cap.

FIG. 8 illustrates a cross sectional view of a preferred cap 100 with fin 110. While the cap and base can be of any suitable dimensions, the following dimensions are provided for exemplary purposes. Although referencing the cap 100, these dimensions can be used with the base as well where applicable (e.g., excluding fin). The length of the cap 100 can be about 4.338 inches, or between 4 to 5 inches, or 3 to 6 inches, or substantially so. The width of the cap 804 can be about 2.168 inches, or between 1.5 to 2.5, or 1 to 3 inches, or substantially so. In general the width of the cap can be about half the length of the cap. The height of the fin 110 can be about 0.5 inches, or between 0.25 to 1 inches, or 0.2 to 2 inches, or substantially so. The total height of the cap 100 with fin 110 can be about 1.125 inches, or between 1 to 1.5 inches, or 0.5 to 2 inches, or substantially so. The thickness of material between the upper surface areas 126*a* and 126*b* and the top of the cylindrical recesses 120*a* and 120*b* can be about 0.125 inches or between 0.1 to 0.5 inches or substantially so. Preferred embodiments include caps composed of ABS Cycolac FR15.

Figure 9:
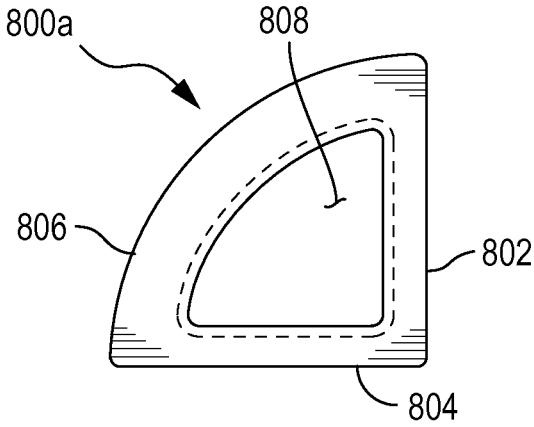
FIG. 9 is a top view of a paver shim.
Figure 11:
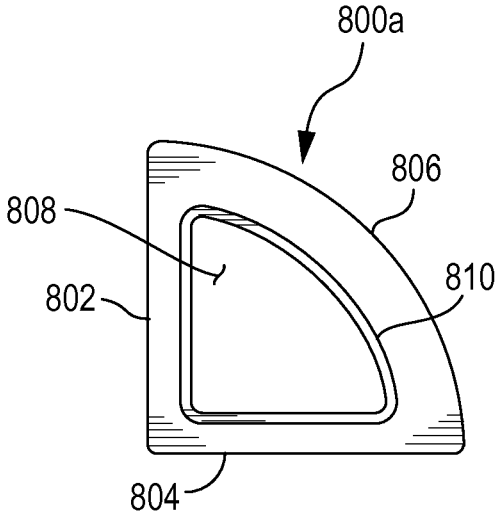
FIG. 11 is a bottom view of a paver shim.
Figure 10:
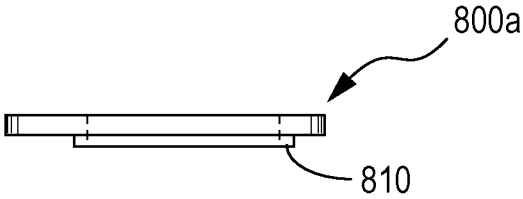
FIG. 10 is a side view of a paver shim.

Shims 800*a* and 800*b* are thin and preferably tapered pieces of material, used to permit relative height adjustment of pavers 900 resting on the cap 100 by compensating for minor variations in paver thickness. More specifically, as the upper surfaces of paver patios and decks are primarily designed to be level and uniform, shims 800*a* and 800*b* can allow a user to overcome unlevel irregularities in the paver 900 or even the floor surface under the base 200. FIGS. 9, 10, and 11 illustrate the top, front, and bottom views, respectively, of a preferred paver shim 800*a*. It is noted that while this left side shim 800*a* is shown in detail, it is preferred that the right side shim 800*b* is identical in form.

When viewed from the top a preferred shim 800*a* shown in FIGS. 9-11, is pie-shaped in appearance, having two straight sides 802 and 804 which intersect at a 90 degree angle, or substantially so, and a third convex side 806 which connects the two. The shims 800*a* and 800*b* may be positioned on the cap 100 in any of the cutouts 102*a* and 102*b*. Preferably a cutout 808 in the shim 800*a* is in congruence with the cutouts 102*a* and 102*b* in the cap 100, and is bounded on the underside by a rim 810. The shim's cutout 808 is also advantageous in draining water from the top of the cap 100, especially when aligned with the cap's cutouts 102*a* and 102*b*. When a shim 800*a* is positioned within a cutout 102*a*, it is preferred the rim 810 rests on top of cutout flanges 104*a* and 106*a*. When so positioned, the rim 810 can functionally interlock the shim 800*a* with the cap 100 so as to prevent lateral sliding of the shim 800*a*. It is also preferred that the straight line 802 of the left shim 800*a* (and corresponding straight line on the right shim) abuts against the fin 110 when positioned within its respective cutout 102*a* on the cap 100.

Alternatively, in other embodiments, no flanges are present in the cap cutouts and the rim 810 is configured to project downward and interlock within the cylindrical recess 124*a*. The weight of the pavers 900 can also keep shims 800*a* and 800*b* positioned securely within the cutouts 102*a* and 102*b*. It is also preferred that the sides 802, 804, and 806 of the shims 800*a* and 800*b* are configured such that they do not block central drainage holes 116*a* and 116*b* or outer drainage holes 108*a* and 108*b* when positioned within their respective cutouts 102*a* and 102*b*. The shims 800*a* and 800*b* can be of any suitable thickness, such as $1/16^{th}$ inch and $1/8^{th}$ inch, for example. Preferably, paver shims 800*a* and 800*b* having different thicknesses can be sold with the pedestal assemblies 600 herein or otherwise be made available to the user. Any suitable shims and complementary cutout shapes on the cap can be used with the teachings herein. More specifically the shims disclosed in U.S. Pat. No. 6,520,471 and those sold with AWS® PEDESTAL SYSTEMS™ (Seattle, Wash.) can readily be incorporated with the pedestal assemblies provided herein.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description. All references cited are expressly incorporated herein by reference in their entireties.

What is claimed is:

1. A pedestal assembly configured to utilize first and second towers to support first and second adjacent pavers, and comprising:

a base having an upper surface with first and second means for respectively coupling to and supporting bottom ends of first and second towers;

a cap having an upper surface configured to support the undersides of said first and second adjacent pavers and an underside having first and second means for respectively coupling to top ends of said first and second towers;

wherein the cap and the base individually comprise a perimeter defined by front and back sides that are parallel to one another and left and right sides that couple the front and back sides together; and wherein the upper surface of the cap has an upwardly projecting fin that traverses perpendicular to the front and back sides and is positioned in the center of the cap to serve as a divider between the first and second adjacent pavers when placed on top of the cap and wherein the upper surface of the cap lacks a cross shaped fin; and first and second adjacent pavers positioned on the upper surface of the cap and divided by the perpendicular fin.

2. The pedestal assembly of claim 1, further comprising first and second towers configured to be positioned between the cap and base such as to separate the cap and base and to provide sufficient load bearing support for said first and second pavers positioned on the upper surface of the cap.

3. The pedestal assembly of claim 1, wherein the cap and the base are racetrack-shaped such that the left and right sides of the perimeter are curved.

4. The pedestal assembly of claim 1, wherein the left and right sides of the base and cap are parallel to one another and are perpendicular to the front and back sides.

5. The pedestal assembly of claim 1, wherein the fin is positioned between the left and right sides on the cap, and wherein the left side include first means for coupling to the topside of the first tower and the right side includes second means for coupling to the topside of the second tower.

6. The pedestal assembly of claim 1, wherein the fin is the only upwardly projecting member on top of the cap.

7. The pedestal assembly of claim 2, wherein the means for coupling to the top and bottom of the towers on the cap and base are cylindrical recesses and the towers are cylindrical in shape.

8. The pedestal assembly of claim 7, wherein the first and second towers are formed of polyvinyl chloride (PVC) plastic tubing.

9. The pedestal assembly of claim 1, wherein the cap and the base individually have no more than two means for coupling to two towers, such that no more than two towers can be coupled and positioned between said cap and base.

10. The pedestal assembly of claim 5, wherein the cap includes a first cutout on its right side and a second cutout on its left side, wherein said cutouts are individually configured to hold a paver shim.

11. The pedestal assembly of claim 1, further comprising:

a second pedestal assembly configured to utilize no more than a single tower to support corners of four adjacent pavers, and comprising:

(i) a base having an upper surface having means for respectively coupling to and supporting the bottom end of the single tower; and (ii) a cap having an upper surface having an upwardly projecting spacer configured to separate the underside corners of four pavers and an underside having means for coupling to the top end of the single tower.

12. The pedestal assembly of claim 2, wherein the first and second towers are hollow.

13. The pedestal assembly of claim 10, further comprising first and second shims configured to fit within the first and second cutouts such that one side of the first shim abuts against a first side of the fin, and one side of the second shim abuts against a second side of the fin.

14. A pedestal assembly configured to utilize first and second towers to support first and second adjacent pavers, and comprising:

a base having an upper surface with first and second means for respectively coupling to and supporting bottom ends of first and second towers;

a cap having an upper surface configured to support the undersides of said first and second adjacent pavers and an underside having first and second means for respectively coupling to top ends of said first and second towers;

wherein the cap and the base individually comprise a perimeter defined by front and back sides that are parallel to one another and left and right sides that couple the front and back sides together;

a releasably attachable upwardly projecting fin, wherein the upper surface of the cap includes means for releasably attaching the upwardly projecting fin such that the fin traverses perpendicular to the front and back sides and is positioned in the center of the cap to serve as a divider between the first and second adjacent pavers when placed on top of the cap and wherein the upper surface of the cap lacks a cross shaped fin;

first and second adjacent pavers positioned on the upper surface of the cap and divided by the releasably attachable perpendicular fin.

15. The pedestal assembly of claim 14, further comprising first and second hollow towers configured to be positioned between the cap and base such as to separate the cap and base and to provide sufficient load bearing support for said first and second pavers positioned on the upper surface of the cap.

16. The pedestal assembly of claim 14, wherein the means for releasably attaching the upwardly projecting fin on the cap is positioned between the left and right sides on the cap, and wherein the left side include first means for coupling to the topside of the first tower and the right side includes second means for coupling to the topside of the second tower, wherein the cap includes a first cutout on its right side and a second cutout on its left side, wherein said cutouts are individually configured to hold a paver shim, and wherein the assembly further comprises first and second shims configured to fit within the first and second cutouts such that one side of the first shim abuts against a first side of the upwardly projecting fin, and one side of the second shim abuts against a second side of the upwardly projecting fin.

17. The pedestal assembly of claim 14, wherein the cap and the base are the same piece.

* * * * *